United States Patent [19]

Clark

[11] 4,367,676

[45] Jan. 11, 1983

[54] POSTAGE METER VALUE SELECTING SYSTEM

[75] Inventor: John I. Clark, Milford, Conn.

[73] Assignee: Pitney Bowes, Inc., Stamford, Conn.

[21] Appl. No.: 266,561

[22] Filed: May 22, 1981

[51] Int. Cl.[3] ..... B41J 1/20

[52] U.S. Cl. ..... 101/91; 101/109; 101/77; 101/86

[58] Field of Search ..... 101/77, 86, 87, 91, 101/92, 109

[56] References Cited

U.S. PATENT DOCUMENTS

| | | | |
|---|---|---|---|
| 2,934,009 | 4/1960 | Bach et al. | 101/235 |
| 3,938,095 | 2/1976 | Check et al. | 340/172.5 |
| 3,965,815 | 6/1976 | Lupkas et al. | 101/91 |
| 3,978,457 | 8/1976 | Check et al. | 340/172.5 |
| 4,050,374 | 9/1977 | Check | 101/91 |
| 4,077,318 | 3/1978 | Tamai | 101/91 |
| 4,140,054 | 2/1979 | Martin et al. | 101/91 |
| 4,140,055 | 2/1979 | Lallemand | 101/91 |
| 4,178,847 | 12/1979 | Erhardt | 101/91 |
| 4,250,806 | 2/1981 | Boyson et al. | 101/86 X |

*Primary Examiner*—Edward M. Coven

*Attorney, Agent, or Firm*—David E. Pitchenik; W. D. Soltow, Jr.; Albert W. Scribner

[57] ABSTRACT

A value selection system for a postage meter includes a plurality of print wheels rotatably mounted within a print drum. The print drum is coupled to be driven to rotate such that selected print elements on each of the print wheels are moved to imprint a postage value on a mail piece or other postage imprint receiving surface. The print wheels are selectively positioned by a print wheel value selection mechanism which is operable to set the print wheels during any time within a printing cycle except when the actual imprint is being impressed. The mechanism is operable to move the print wheels when the print drum is at rest and when the print drum is in motion. The position of the print wheels and the print drum may be monitored to account for the printing of postage by the meter.

18 Claims, 6 Drawing Figures

Fig.4
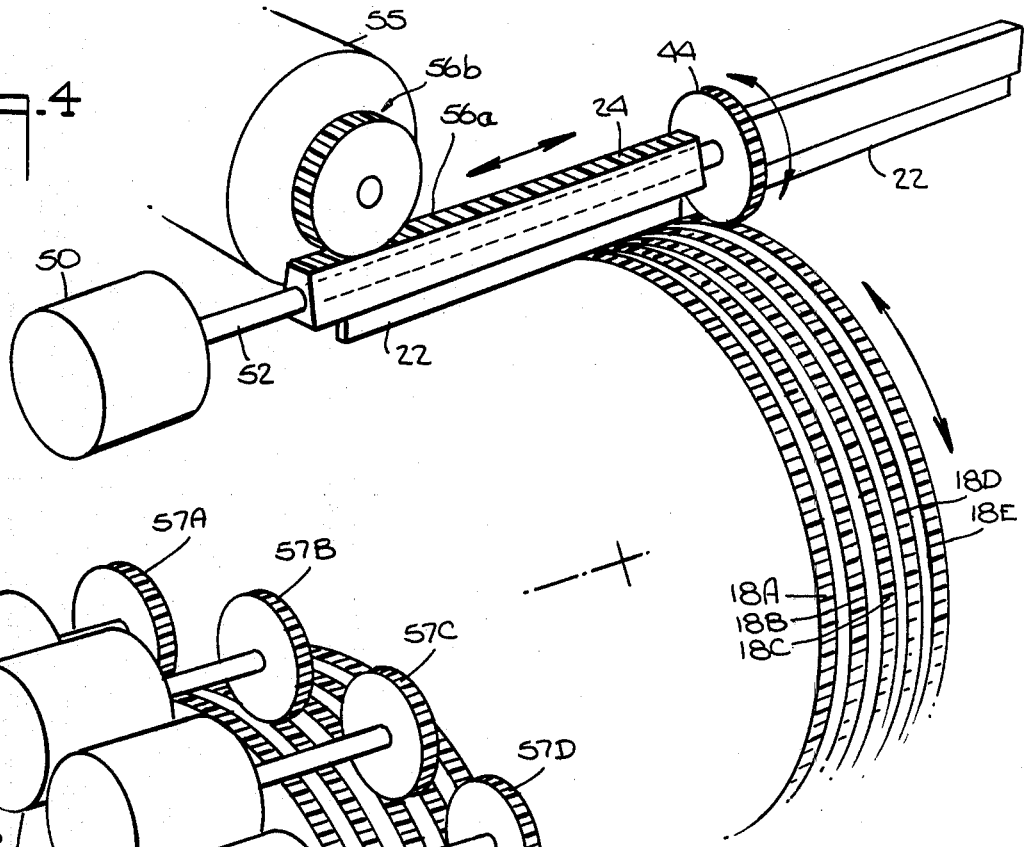
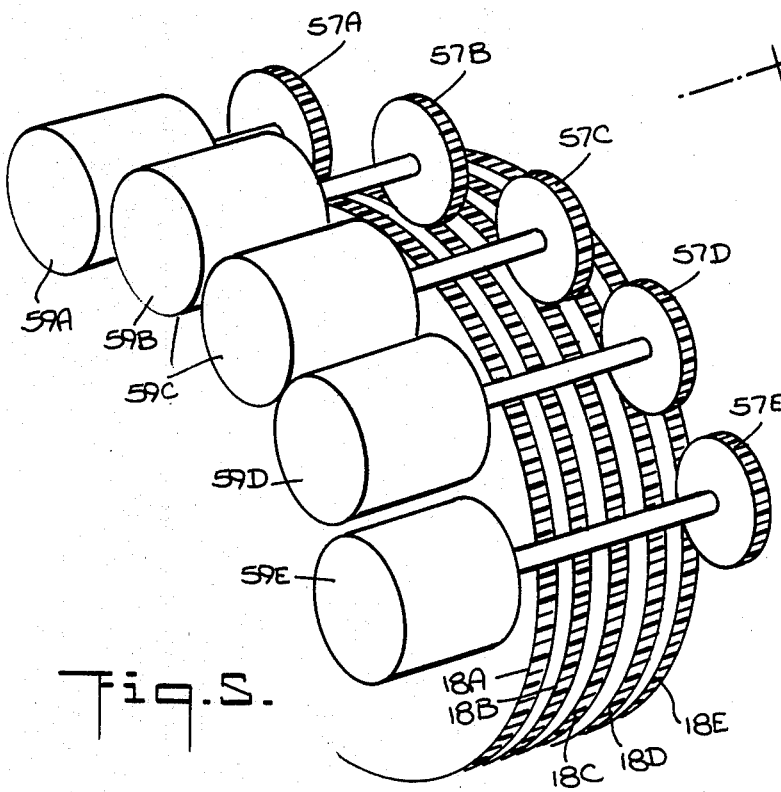
Fig.5.
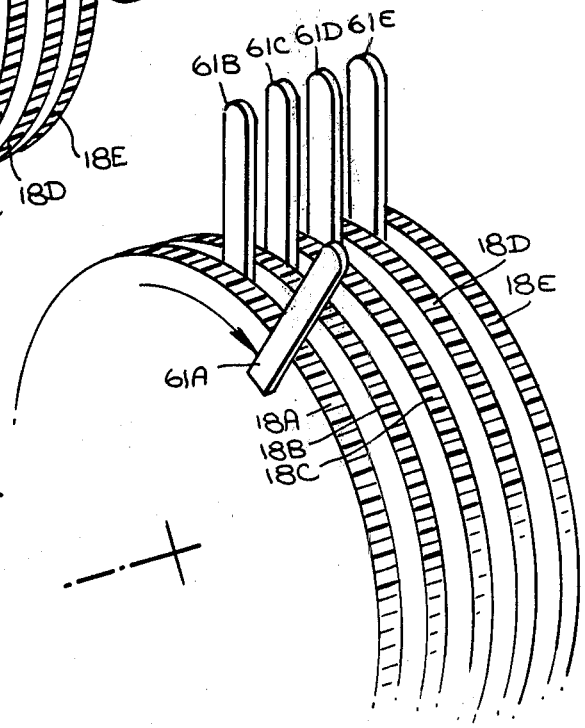
Fig.6.

POSTAGE METER VALUE SELECTING SYSTEM

FIELD OF THE INVENTION

Present invention relates to a character selection mechanism for rotary drum printers, and more particularly, to a value selection mechanism for rotary print drum type postage meters.

BACKGROUND OF THE INVENTION

Postage meters are devices for dispensing value in the form of postage printed on a mail piece such as an envelope. The term postage meter also includes other similar meters such as parcel post meters. Meters of this type print and account for postage stored in the meter. Mechanisms are provided in the meter to select a particular value of postage to be printed on a mail piece.

Postage meters have been developed with electronic accounting systems. Postage meter systems of this type are disclosed in U.S. Pat. No. 3,978,457 for Microcomputerized Electronic Postage Meter System and in U.S. Pat. No. 3,938,095 for Computer Responsive Postage Meter. With the development of electronic postage meters, it has been desired to develop value selection mechanisms which cooperate with the electronic circuits in a manner to enhance the capabilities of the postage meter.

Postage meter printing systems suitable for use with electronic postage meters, such as those disclosed in U.S. Pat. No. 3,965,815 for Setting Mechanism for a Postage Printing Device and U.S. Pat. No. 4,050,374 for Meter Setting Mechanism, include a printing drum with a set of adjacent printing wheels each of which carries print characters. Each print wheel is set to position a different postage amount character for printing by an independently rotatable gear mechanism adapted to be engaged by a master gear. The master gear is rotatably mounted within a laterally movable carriage. The carriage can be moved to cause successive engagement of the master gear with independently rotatable gear mechanisms. The printing drum is energized to rotate to print postage by a drive gear within the meter. Meter printing systems of this type are often detachably mounted on a drive base. When so mounted, the postage meter drive gear meshes with a drive gear in the base. One suitable drive base is disclosed in U.S. Pat. No. 2,934,009 for Sheet Feeding and Treating. These mechanisms operate satisfactorily for their intended purposes.

It has been recognized that it may be desirable to perform a value setting operation during rotation of the printing drum. One system for accomplishing such setting is disclosed in U.S. Pat. No. 4,140,055 for Automatic Device for Value-Setting of Print Wheel in a Franking Machine. With the mechanism disclosed in the patent, however, the drum must be in rotation during the value selection. This requires that the full selection process be both operated and completed prior to each print cycle since the value selection must be operated whether or not the value of the postage to be printed changes from the proceeding print cycle. This adds wear to the mechanism. Moreover, the flexibility which is obtainable by electronic postage meters is sacrificed in that the selection mechanism cannot be operated when the print drum is at rest.

SUMMARY OF THE INVENTION

The present invention provides a mechanism which is particularly adaptable to a large number of different mechancial and electro-mechanical control means. This provides flexibility in utilizing the selection mechanism in a large number of different product configuration suitable to meet different user requirements. The system of the present invention allows value selection with the print drum at rest or in motion. Since the mechanism can be used in both manners the same mechanism can be used in a slow speed setting mechanism, such as a manual system, while the print drum is at rest or in a high speed print value setting mechanism while the drum is at rest, during rotation or during periods which include both conditions. Additionally, the structure of the present invention only requires the repositioning of components when a value of postage to be printed has been changed from the previous setting. This provides reduction in the wear of the components with the attendent increase in reliability, since many postage printing operations are repetitive printing of the same postage value amount. Moreover, the system allows positioning of rotary components in either direction by the shortest path for further reduction in wear and reduction in time required for repositioning of components in high speed postage meters. The system may be used to position print wheels for purposes other than value amounts such as dates and the like.

BRIEF DESCRIPTION OF THE DRAWINGS

A complete understanding of the present invention may be obtained from the following detailed description thereof when taken in conjunction with the accompanying drawings, in which:

FIGS. 4–6 are perspective views of several different input systems for driving the print wheel value section mechanism.

DETAILED DESCRIPTION OF THE INVENTION

Figure 1:
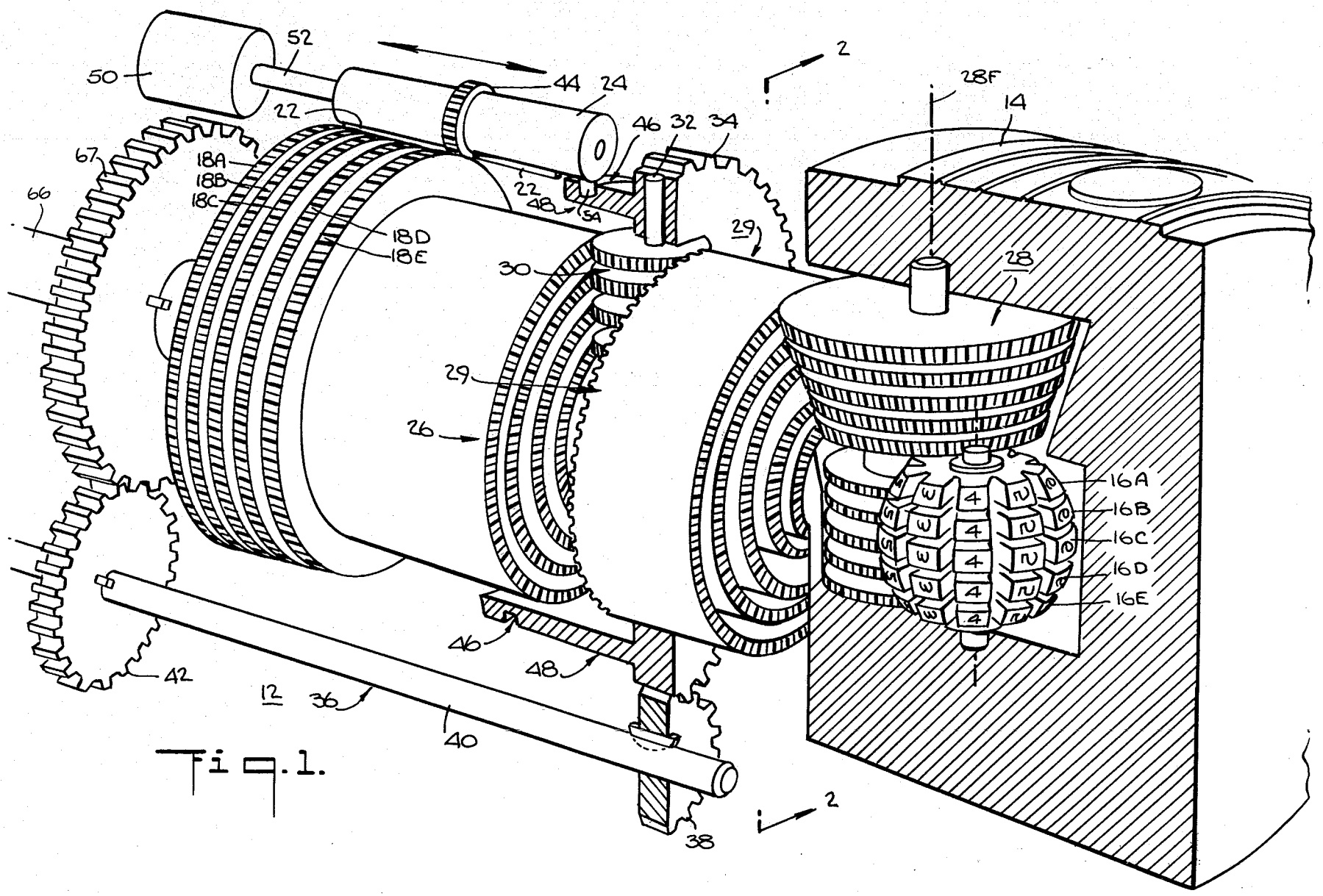
FIG. 1 is a perspective view, partially in section, of a postage meter printing mechanism including a value selection system embodying the present invention.

Reference is now made to the drawings wherein like reference numerals designate similar elements in the various FIGURES. A postage meter printing mechanism 12 includes a rotary print drum 14. The print drum 14 carries a stack of print wheels 16A, 16B, 16C, 16D, and 16E. The wheels protrude through the face of the print drum 14 to imprint postage value amount characters or other variable data on a mail piece, not shown. The print wheels are settable to any combination of value characters for imprinting postage with any number of selectable places. Five print wheels are shown for convenience of illustration.

Figure 2:
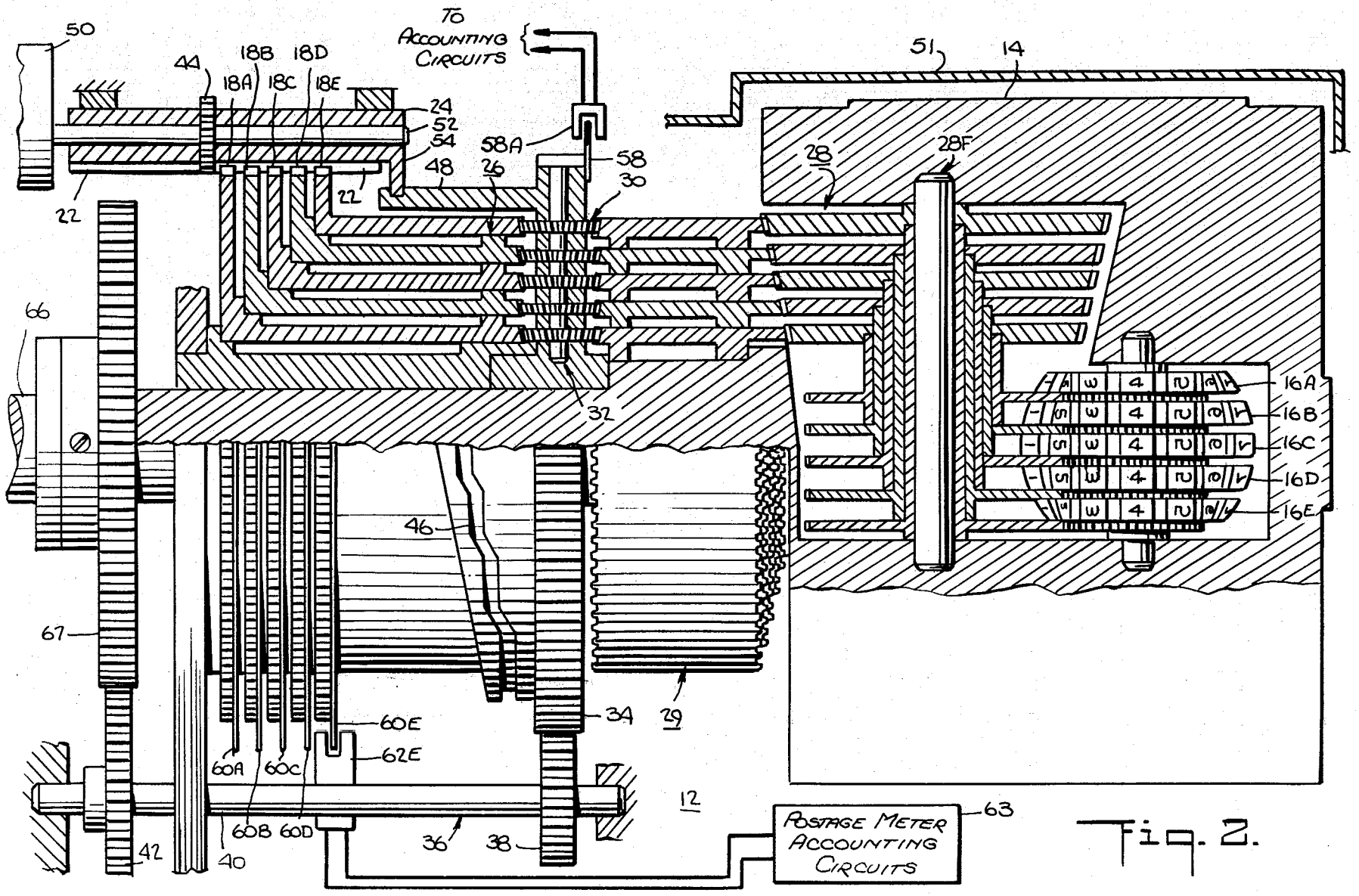
FIG. 2 is a side view of the postage meter printing mechanism shown in FIG. 1.
Figure 3:
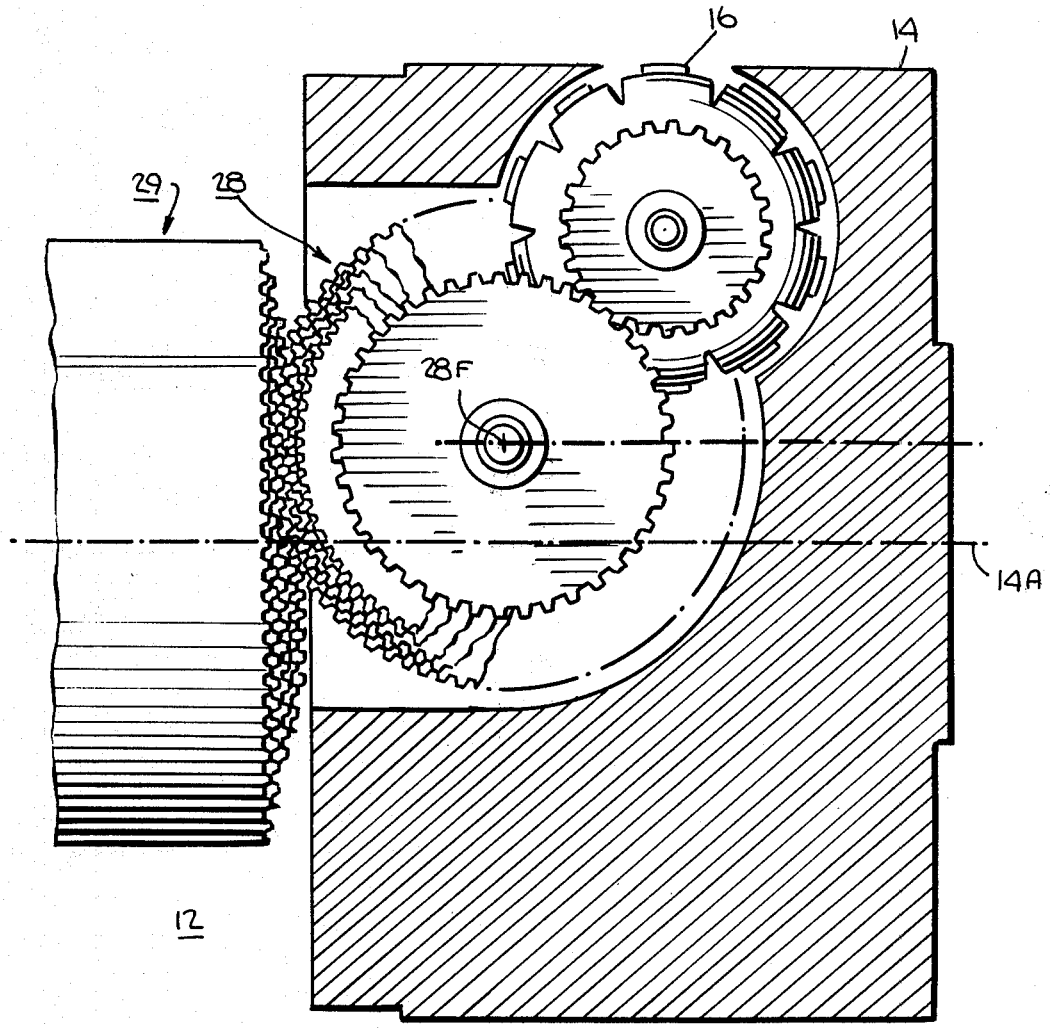
FIG. 3 is a bottom view of a portion of the postage meter printing mechanism shown in FIG. 2 helpful in an understanding of the invention.

When the print drum 14 is in rotation during the printing operation, and with no value selection for the print wheels 16 in process, an input cluster or gears 18 including gears 18A, 18B, 18C, 18D and 18E are held fixed relative to the postage meter frame by a spline surface 22 (FIGS. 1, 2 and 4). The spline surface 22 is on a bank selection slide 24. The bank selection slide 24 is operated to be moved, as will hereinafter be explained in greater detail, to enable value setting of any one of the five print wheels 16A through 16E.

An output gear cluster 29, a transfer gear cluster 28, and print wheels 16 are held fixed relative to the rotating print drum 14 by means of the differential action of five planetary gears 30. The planetary gears 30 are rotatably mounted on pin 32 (FIGS. 1 and 2) within the body of a gear 34. Gear 34 with its attached planetary gears 30 is driven at one-half the speed of the print drum 14 and in the same direction. The drive for gear 34 is obtained by means of a reduction gear train 36 including the gear 38, the shaft 40, the gear 42, and drum drive gear 67 mounted on drum shaft 66.

Bank selection in the mechanism disclosed in FIGS. 1 and 2 is such that only a single stepper motor is required for operation of the printing mechanism. The bank selection is provided by translation of the bank selection slide 24 carrying a selection pinion gear 44. The slide 24 is caused to move by a barrel cam groove 46 in flange 48 which is fabricated integrally with the gear 34. Gear 34 rotates one-half revolution for each print cycle. Gear 34 carries the bank selection slide 24 in opposite directions on alternative cycles thereby positioning the selection pinion gear 44 for a full five bank print wheel selection each cycle, and ending in either of two home positions (disengaged from gears 18A–18E) before printing contact of the print wheels 16 and a mail piece occur. Barrel cam groove 46 is stepped to cause selection pinnion gear 44 to dwell during each mesh with gears 18A–18E for sufficient time to complete selection positioning of one print wheel 16A–16E. It should be noted that although this mechanism involves the positioning of the pinion gear 44 through all five selection positions during each print cycle. Such a structure is only one of many input structures which can suitably be used with the present invention for value selection. Other structures do not involve the movement of the value selection input mechanism during each print cycle, as for example a series of five selection pinions (FIG. 5) each engaging one member of the input cluster 18 for separate and parallel value selection inputs.

Selection pinion gear 44 is set in the center of the spline surface 22 and provides for the rotation of only one of the input gears 18 at a time while the spline holds the remaining input gears fixed. When a value selection is required, the pinion gear 44 is rotated by a single stepping motor 50 (FIG. 1) which has a splined bore mating with a splined pinion gear shaft 52 on which the pinion gear 44 is mounted. It should be noted that the stepper motor 50 may be located either internal or external to the postage meter enclosure 51 which provides a secure housing to prevent tampering with the print wheels.

In the embodiment shown in FIGS. 1 and 2, the stepper motor 50 is timed to allow the completion of a maximum five bank selection in a portion, such as two-thirds, of the print drum 14 rotation every cycle, whether or not a value change is required. With a stepper motor arrangement, as is shown in FIG. 4, or other suitable drive mechanism, the pinion gear 44 is moved to be properly positioned, as required. In this embodiment, the cam follower 54 for bank selection slide 24 is eliminated and the slide is translated for bank selection under operation of the stepper motor 55 by means of a rack 56*a* on slide 24 and pinion 56*b*.

As is shown in FIG. 5, a five parallel input system may be employed with the value selection mechanism of the present invention, eliminating the need for the bank selection slide and the associated mechanisms. The input gears 18 are directly driven by five pinion gears 57A–57E which, if desired, may be radially dispersed around the axis of rotation and may be separately driven by five stepper motors 59A–59E.

As is shown in FIG. 6 manual selection can be accomplished by detented levers 61A–61E secured to the input gears 18A–18E.

Referring again to FIG. 2, electrical information concerning the position of the print wheels is obtained by means of encoding disks and photo detecting devices as is disclosed in the above-noted patents. Encoding surface 58 mounted on gear 34 for bank selection sensing which cooperates with a photo sensor 58A.

Encoding surfaces 60A–60E may also be provided on the input gears 18 and used in conjunction with a series of photo sensors, only sensor 62E being shown. The photo sensors, may be angularly dispersed about the center of rotation of the print drum 14 or, alternatively, the input gears 18 may have diameters stepped to accommodate sensor mounting requirements. If this form of print wheel selection feedback is employed, the ratio on the gears will be such to insure that the print wheels make a whole number of revolutions during one revolution of its associated input gear 18. An encoding surface and photo sensor, not shown, are connected to the print drum to sense an imprinting operation. It should be recognized that the encoding surfaces and photo sensors are positioned to monitor and provide signal information to the postage meter accounting circuit 63 concerning the print wheel settings and print cycles. The postage meter accounting circuits account for the printing of postage by the printing mechanism 12. The accounting circuits control the stepping motors of FIGS. 1–5 to inhibit the setting of the print wheels 16 to a value which exceeds the amount of postage remaining in the meter and available for printing. These circuits may be similar to the circuits shown in the aforementioned U.S. Pat. Nos. 3,978,457 or 3,938,095 or a pending U.S. patent application Ser. No. 089,413 filed Oct. 30, 1979 for Electronic Postage Meter Having Plural Computing Systems.

Simple mechanical logic providing for zero stops on the selection trains to be used in an initialization routine may be provided. Such an initialization routine performed automatically at appropriate times enable the postage meter accounting circuits 63 and the control circuit for the postage meter to be signaled as to the beginning position of the postage value print wheels and facilitates the electrical control for setting. For example, a lug or stop on a gear may hit a rotatable bale which is selectively moved to cause the mechanical components to assume a predetermined position during initialization. As an additional feature, the print wheels may be caused to be displaced one-half character space for security purposes during a portion of the print drum 14 rotation. Under such an arrangement, the print wheel will be driven to return to the correct registration the instant preceeding the printing contact by means of non-circular gears in the two to one gear reduction train 36.

It is the function of the selection mechanism of the present invention to position the print wheels 16A, 16B, 16C, 16D and 16E located within the rotatable print drum 14 in response to positioning of input gears 18A, 18B, 18C, 18D and 18E located on the fixed frame of the postage meter. Each input gear is coupled by means of an independent gear train to its corresponding print wheel. Rotation of any or all input gears relative to the frame will produce a corresponding rotation of print wheels relative to the rotatable print drum and fixing of the input gears relative to the frame will hold the print wheels fixed relative to the rotatable drum. Any desired rotational positioning of the print wheels relative to the drum is accomplished with identical displacements at the input gears whether the drum is in rotation or fixed at rest. Fixing of the input gears relative to the frame will hold the print wheels fixed relative to the drum whether the drum is in rotation or at rest.

Input gears 18A, 18B, 18C, 18D and 18E are arranged in a concentric cluster with each gear independently rotatable about print drum shaft 66. Each input gear face (ex. 18E FIG. 1) carries a second gear face 26 on the end of its hub which meshes with one of a stack of planetary bevel gears 30. Gears 30 are stacked on and free to rotate about shaft 32 located in the body of gear 34. Gear 34 is rotatable about drum shaft 66 under control of gear train 36 carrying shaft 32 and the stack of planetary gears 30 in rotation with it. Planetary gears 30 are in mesh with corresponding output gears 29 arranged in a concentric cluster with each gear independently rotatable about drum shaft 66. Each output gear 29 carries a second gear face mating with a corresponding gear face on gears 28. Gears 28 are arranged in a cluster of concentric hubs with each hub independently rotatable on shaft 28F mounted in print drum 14. Each gear 28 carries a second gear face at the opposite end of its hub in mesh with a gear face attached to a corresponding print wheel.

In operation, with the print drum 14 at rest, gear 34 is also at rest holding planetary gear shaft 32 fixed. Rotation of an input gear, for example gear 18E, produces an equal and opposite rotation of output gear 29 through gear 30 which functions as a simple idler gear. Output gear 29 in turn drives printwheel 16E through one of the intermediate cluster gears 28. In this manner any print wheel, here print wheel 16E, is displaced proportionally to the displacement of its corresponding input gear.

In operation with the print drum 14 in rotation, gear 34 is driven to rotate in the same direction and at exactly half the speed of print drum 14 and drum shaft 66 by means of gear train 36. Rotation of compensating gear 34 carries the planetary gear stack 30 causing a differential action which exactly cancels any displacement of the print wheels during rotation of the print drum except that displacement of the print wheels which is produced in response to displacement of input gears 18A, 18B, 18C, 18D or 18E.

By way of further explanation, with the input gears 18 fixed relative to the frame and the print wheels locked mechanically to prevent rotation relative to the drum, transfer gear cluster 28, output gear cluster 29 and the print wheels 16 are all fixed relative to drum 14, and will rotate together as a unit. If compensating gear drive train 36 is disconnected from compensating gear 34, gear 34 and its attached planetary gears 30 would be free to seek any position determined by input gears 18 and output gears 29. In such case, with input gears 18 remaining fixed relative to the frame, rotation of print drum 14 and output gears 29 will cause rotation of compensating gear 34 at a speed equal to ½ the speed of the drum according to well understood principles of differential gearing. If, however, the structure (as is shown in the drawings) provides a positive drive of gear 34 at exactly ½ the speed of print drum 14, the print wheels will be maintained fixed relative to the drum without the use of mechanical locking means. Displacement of input gears 18 will, however, produce a corresponding displacement of print wheels 16 independently of any effect due to rotation of the drum.

It should be noted that for the structure shown in the various FIGURES (and as is most apparent in FIG. 3), a hypoid or other type of known tooth form suitable for skewed shafts is required in order to mesh the gears 28 and 29. Where the limitations of such tooth form and the restrictions of construction requirements allow a sufficient increase in this offset, the gears 28 which mesh with the drive gears for the print wheels 16 in the configuration shown may be replaced with print wheels. This alternative configuration will reduce the number of components and eliminate one of the gear interfaces in the gear trains.

What is claimed is:

1. A postage meter of the type adapted to print selected value amounts on a print receiving surface, comprising:

a rotary print drum;

value print means supported within said print drum, said value print means having a plurality of value print elements adapted to be moveably positioned within said print head and further positioned such that each of said plurality of value print elements can be selectively moved into a position to project from the surface of said rotary print drum;

drive means coupled to said print drum for driving said print drum to rotate such that a selected value print element projecting from the surface of said rotary print drum is moved through a position where the selected print element is adapted to imprint on the print receiving surface;

selection means coupled to said value print means for moving said plurality of print elements to position a selected one of said plurality of print elements to project from the surface of said rotary head, said selection means operable to selectively move said plurality of print elements when (1) said drive means is operating to drive said print drum to rotate, (2) when said drive is not operating to drive said print drum to rotate; and accounting means operatively coupled to monitor the position of said print drum and said value print means for accounting for the imprinting of a selected unit value amount.

2. A postage meter as defined in claim 1 including said selection means is coupled to said value printing means by coupling means operable to maintain the position of said value printing means relative to said rotary print drum when said drive means is operable to drive said rotary print drum to rotate.

3. A postage meter as defined in claim 2 wherein said coupling means comprises planetary gear means for providing a differential coupling between said selection means and said value printing means.

4. A postage meter as defined in claim 3 further including a compensating gear and wherein said planetary gear means comprises a stack of planetary gears, said stack of planetary gears rotatably mounted on a compensating gear.

5. A postage meter as defined in claim 4 wherein said compensating gear is coupled to be driven to rotate by said drive means.

6. A postage meter as defined in claim 5 wherein said selection means is operable to change the position of said value printing means relative to the position of said rotary print drum when said selection means is operated to position selected ones of said plurality of print elements to project from the surface of said rotary drum.

7. A postage meter, comprising:

a drive shaft having a drive gear, said drive shaft adapted to be detachably coupled to a postage meter base to be driven to rotate;

a print drum connected to said drive shaft;

a settable print wheel means rotatably mounted within said print drum;

a gear coupled to said drive gear by first drive train means such that said gear is driven to rotate at a predetermined speed proportioned to the speed of rotation of said print drum whenever said print drum is rotated by said drive shaft;

a planetary gear means mounted on said gear;

a second drive train means coupled between said planetary gear means and said plurality of settable print wheel means; and a third drive train means coupled to said planetary gear means and adapted to be operated to change the position of said settable print wheel means relative to said print drum.

8. A postage meter as defined in claim 7 wherein said print wheel means includes a plurality of print wheels and said second and said third drive train means each comprise a concentric gear cluster, said gear clusters of said second and said third gear train means having individually rotatable gear members equal in number to the number of print wheels of said plurality of print wheels.

9. A postage meter as defined in claim 7 further comprising a setting means operatively coupled to said third drive train means.

10. A postage meter as defined in claim 9 wherein said setting means includes a single drive motor a cam surface, a movable gear connected to be driven to rotate by said drive motor, a cam follower coupled to said movable gear and to said cam surface, said drive motor, coupled by said movable gear to said third drive train means, and said cam follower under control of said cam surface operable to position said movable gear through a plurality of positions.

11. A postage meter as defined in claim 9 wherein said print wheel means include a plurality of print wheels and said setting means includes a plurality of motors equal in number to the number of print wheels of said print wheel means and each of said motors coupled to said third drive train means.

12. A postage meter as defined in claim 9 wherein said setting means comprises a manually operable means coupled to said third drive train.

13. A postage meter as defined in claim 9 wherein said setting means includes a first drive means for driving a setting gear to rotate and a second drive means coupled to said setting gear, said second drive means operable to selectively move said setting gear to a plurality of different positions wherein said setting gear is operatively coupled to said third drive train means when said setting gear is in any one of of said plurality of different positions.

14. A postage meter as defined in claim 9 where said print wheels may be rotated in either direction to allow selection of any position of said print wheels by the shortest path.

15. A postage meter, comprising:

a print drum having a surface with an opening therein;

a print drum drive shaft attached to said print drum;

a plurality of print wheels each rotatably mounted in said print drum, each of said print wheels having a plurality of print elements positioned within said print drum such that each print wheel can be rotated to move a selected print element to project through said opening in said surface of said print drum;

a plurality of first gears, each gear of said plurality of first gears fixed to a corresponding one of said plurality of print wheels;

a shaft mounted within said print drum;

a cluster of second gear means mounted for free rotation around said shaft and having first and second gear surfaces, said second gear means positioned such that each first gear surface of said cluster of second gears is coupled to a corresponding one of said plurality of first gears;

a compensating gear mounted for free rotation around said print drum drive shaft;

a stack of planetary gears mounted within said compensating gear and positioned such that each gear of said stack of planetary gears engages a corresponding second gear surface of said cluster of second gears means;

a cluster of third gear means mounted for free rotation around said print drum drive shaft and having a first gear surface, said cluster of third gear means positioned such that each of said first gear surfaces of said cluster of third gear means engages a corresponding gear of said stack of planetary gears; and drive means coupled to drive said compensating gear means at a predetermined rotary speed proportional to the rotary speed of said print drum drive shaft.

16. A postage meter as defined in claim 15 further comprising setting means coupled to said third gear means.

17. A postage meter as defined in claim 16 wherein said setting means comprises a plurality of drive means, each of said drive means coupled to a corresponding one of said plurality of third gear means.

18. A postage meter of the type adapted to print selected value amounts on a print receiving surface, comprising:

a rotary print drum;

value print means supported within said print drum, said value print means having a plurality of value print elements adapted to be movably positioned within said print drum and further positioned such that each of said plurality of value print elements can be selectively moved into a position to project from the surface of said rotary print drum;

drive means coupled to said print drum for driving said print drum to rotate such that a selected value print element projecting from the surface of said rotary print drum is moved through a position where the selected print element is adapted to imprint on the print receiving surface;

selection means coupled to said value print means for moving said plurality of print elements to position a selected one of said plurality of print elements to project from the surface of said rotary head, said selection means operable to selectively move said plurality of print elements when (1) said drive means is operating to drive said print drum to rotate, (2) when said drive is not operating to drive said print drum to rotate and (3) when said drive means is in transition between said conditions (1) and (2); and accounting means operatively coupled to monitor the position of said print drum and said value print means for accounting for the imprinting of a selected unit value amount.

* * * * *